United States Patent [19]

Harbin

[11] 4,428,171

[45] Jan. 31, 1984

[54] THERMAL STOREFRONT SYSTEM

[75] Inventor: Lawrence S. Harbin, Riverdale, Ga.

[73] Assignee: Atlantic Richfield Company, Los Angeles, Calif.

[21] Appl. No.: 357,407

[22] Filed: Mar. 12, 1982

[51] Int. Cl.[3] ..... E04B 1/62

[52] U.S. Cl. ..... 52/398; 49/DIG. 1; 52/772; 52/395

[58] Field of Search ..... 49/DIG. 1; 52/235, 395, 52/398, 400, 397, 404, 772

[56] References Cited

U.S. PATENT DOCUMENTS

| | | | |
|---|---|---|---|
| 2,949,981 | 8/1960 | Ferrell | 52/235 |
| 2,963,126 | 12/1960 | Cudini | 52/302 |
| 3,527,011 | 9/1970 | Bloom | 49/DIG. 1 |
| 4,117,640 | 10/1978 | Vanderstar | 49/DIG. 1 |
| 4,141,188 | 2/1979 | Sukolics | 49/DIG. 1 |
| 4,327,898 | 5/1982 | Grant et al. | 266/67 |

*Primary Examiner*—John E. Murtagh

*Assistant Examiner*—Kathryn L. Ford

*Attorney, Agent, or Firm*—Jones & Askew

[57] ABSTRACT

A storefront system for commercial buildings includes a series of spaced mullions with horizontal supports connected at their ends to the mullions to form a rear support for glass panels. A series of support clips are located at the intersections of the mullions and horizontal supports, with the support clips being fastened to the mullions and with the horizontal supports being mounted to the support clips. Similar support clips are attached to the horizontal supports intermediate the mullions and function to support the glass panels. A plurality of attachment clips also extend from the mullions and horizontal supports, between the glass panels, and cover plates are mounted on the attachment clips. The attachment clips are fabricated from a material having a low coefficient of heat transfer, so that heat from one side of the storefront is not readily transferred to the other side of the storefront.

17 Claims, 9 Drawing Figures

THERMAL STOREFRONT SYSTEM

BACKGROUND OF THE INVENTION

This invention relates to a storefront formed from a support framework of upright mullions and horizontal supports which support glass panels; and more particularly to the shape of the mullions and horizontal supports, to the support clips used for the dual purposes of mounting the horizontal supports to the mullions and of supporting the glass panels, and to the attachment clips which extend from the support framework between the glass panels for connecting cover plates to the support framework to cover the edge portions of the glass panels.

The typical prior art storefront construction which holds a plurality of glass panels in a support framework usually comprises a plurality of upright mullions and horizontal supports which form the support framework, with the mullions connected securely at their tops and bottoms to headers and plates and the horizontal supports connected at their ends to the mullions, with the horizontal supports mounted on brackets that are fastened to the mullions. The glass panels are mounted against the exterior surface of the framework and cover plates are mounted over the adjacent edges of the glass panels. The cover plates are connected by fasteners to the framework between the glass panels.

It is desirable to have the horizontal supports securely mounted to the mullions of a storefront so as to firmly support the glass panels along their horizontal edges as well as their vertical edges, so that when abrupt air pressures are applied to the glass panels by wind, etc., the glass panels will not crack or otherwise become damaged, and so that the assembly will not leak water. Also, it is desirable to minimize the transfer of heat from one side of the storefront to the other side so as to minimize the energy utilized in maintaining the interior of the space in the desired temperature range.

The prior art storefront structures usually include metal mullions and metal horizontal supports, and brackets are screwed to the mullions so that the horizontal supports are mounted at their ends to the brackets. This arrangement sometimes results in the horizontal supports being loosely connected to the mullions so that the horizontal supports tend to become twisted or displaced during the assembly of the storefront and only the mullions provide a secure support for the glass panels. Moreover, the use of brackets to fasten the horizontal supports to the mullions usually requires screws or other fasteners that are exposed externally of the framework. The screws are subject to rust and deterioration, and it is desirable to counter-sink the screws in the material and to use flathead screws so as to avoid forming that is not appealing from a visual standpoint.

After the glass panels have been applied to the support framework, the cover plates are placed over the edges of the glass panels by fasteners that extend from the cover plates between the glass panels to the support framework. The fasteners tend to transfer heat between the support framework which usually is located inside the building and the cover plates which usually are located outside the building.

SUMMARY OF THE INVENTION

Briefly described, the present invention comprises a thermal storefront system of the type suitable for use in a commercial building, which includes a support framework formed from upright mullions and horizontal supports extending between the mullions. The mullions and horizontal supports are of identical cross-sectional shape, with each including an elongated centrally located recess, with the recesses of the mullions and horizontal supports facing the plane in which the glass panels are to occupy. A support clip is utilized in the structure for two puposes: to attach the horizontal supports to the upwardly extending mullions, and to support the glass panels in the framework. The support clips are an extruded aluminum product, and slots are cut in the support clips so that the support clips can span a mullion and support the end portions of the horizontal supports from the mullion on opposite sides of the mullion. When the support clip is utilized to support a glass panel from a horizontal support, no slots in the support clip are necessary.

In addition, attachment clips are inserted in the recesses of the horizontal supports and of the mullions and protrude from the supporting framework between the glass panels, and cover plates are attached to the attachment clips by snapping the coverplates about the protruding ends of the attachment clips. No exposed screws or other type fasteners are required to mount the coverplates to the assembly. The attachment clips are a molded plastic product, such as Celcon, which has a relatively low heat transfer coefficient, so that the heat from one side of the storefront system is not readily transferred to the other side of the storefront system.

Thus, it is an object of this invention to provide a thermal storefront system which includes a support framework of mullions and horizontal supports and which includes a support clip that can be used to connect the horizontal supports of the framework to the mullions and also can be used to mount the glass panels to the framework.

Another object of this invention is to provide a thermal storefront system which includes a support framework of mullions and horizontal supports, with glass panels supported at their edges by the framework, and which includes attachment clips for reliably and rapidly connecting cover plates about the edges of the glass panels and to the support framework on the opposite side of the glass panels from the framework.

Another object of this invention is to provide a storefront system which can be rapidly assembled, which includes a support framework in which the horizontal supports are securely mounted to the mullions, which forms a reliable liquid seal at the edges of the glass panels, and which includes internal attachment clips that extend from the support framework between the glass panels and connect the external cover plates to the system, with the attachment clips being formed of a molded plastic material having a relatively low coefficient of heat transfer.

Other objects, features and advantages of the present invention will become apparent upon reading the following specification, when taken in conjunction with the accompanying drawings.

DETAILED DESCRIPTION

Figure 1:
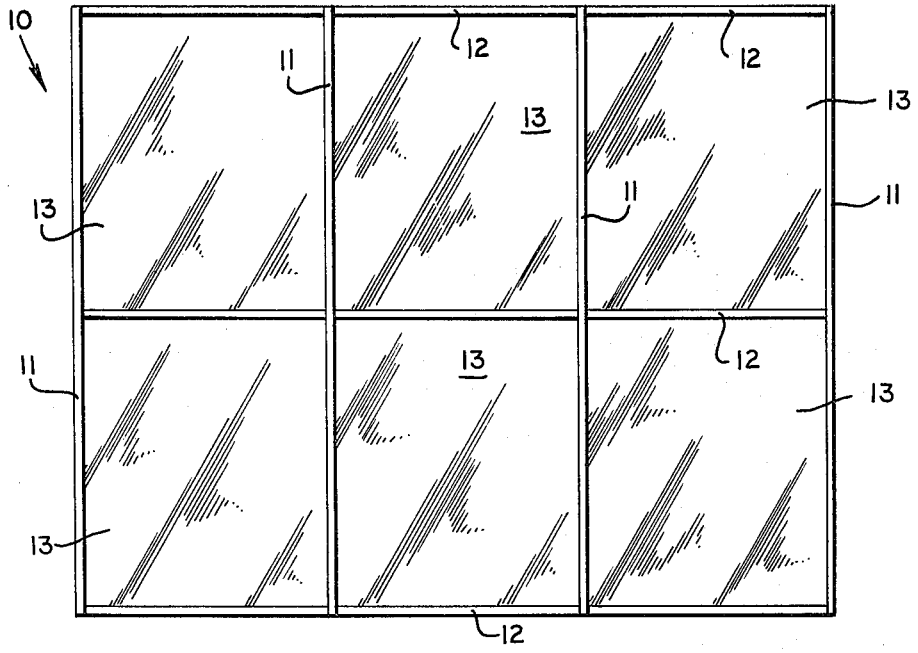
FIG. 1 is an elevational view of a portion of the thermal storefront system.

Referring now in more detail to the drawings, in which like numerals indicate like parts throughout the several views, FIG. 1 illustrates the thermal storefront system 10 which includes a plurality of spaced apart parallel mullions 11 that are usually oriented in an upright attitude, and a plurality of horizontal supports 12 which extend between the mullions 11. Rectangular glass panels 13 are supported by the mullions and horizontal supports. The glass panels can be single thickness panels or double panels, as desired.

Figure 8:
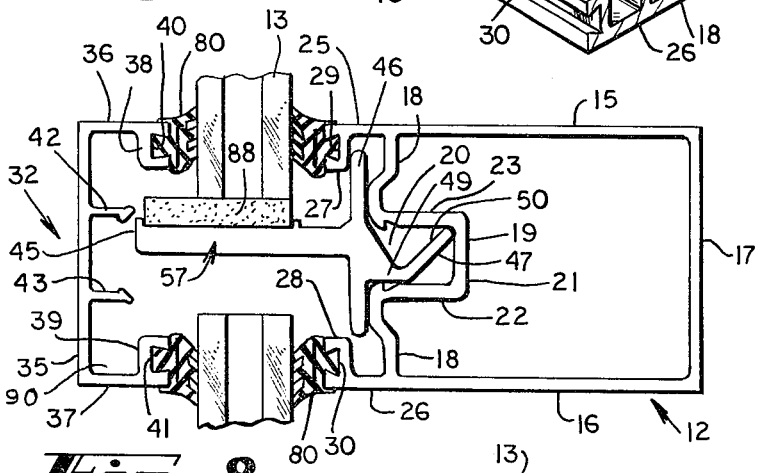
FIG. 8 is a side cross-sectional view of a horizontal support, an unslotted support clip, glass panels above and below the support clip, and a cover plate applied to the assembly.

The mullions 11 and horizontal supports 12 are of identical cross-sectional shape and are extruded aluminum products. As illustrated in FIG. 8, each mullion and horizontal support is approximately of rectangular cross-section and includes opposed side walls 15 and 16, back wall 17 and front wall 18. Front wall 18 includes a U-shaped portion 19 that forms a recess 20. The U-shaped portion includes inner wall 21 and opposed side walls 22 and 23. The opposed side walls 22 and 23 form a lower upwardly facing shelf 22 and an upper downwardly facing shelf 23 against which the attachment clips and support clips are supported, as will be disclosed in more detail hereinafter. Additionally, the horizontal supports 12 and mullions 11 include extensions 25 and 26 that extend coextensive with the opposed side walls 15 and 16 and project beyond the U-shaped front wall 18. L-shaped flanges 27 and 28 extend inwardly from the extensions 25 and 26, and slots 29 and 30 are formed by the L-shaped flanges.

Figure 2:
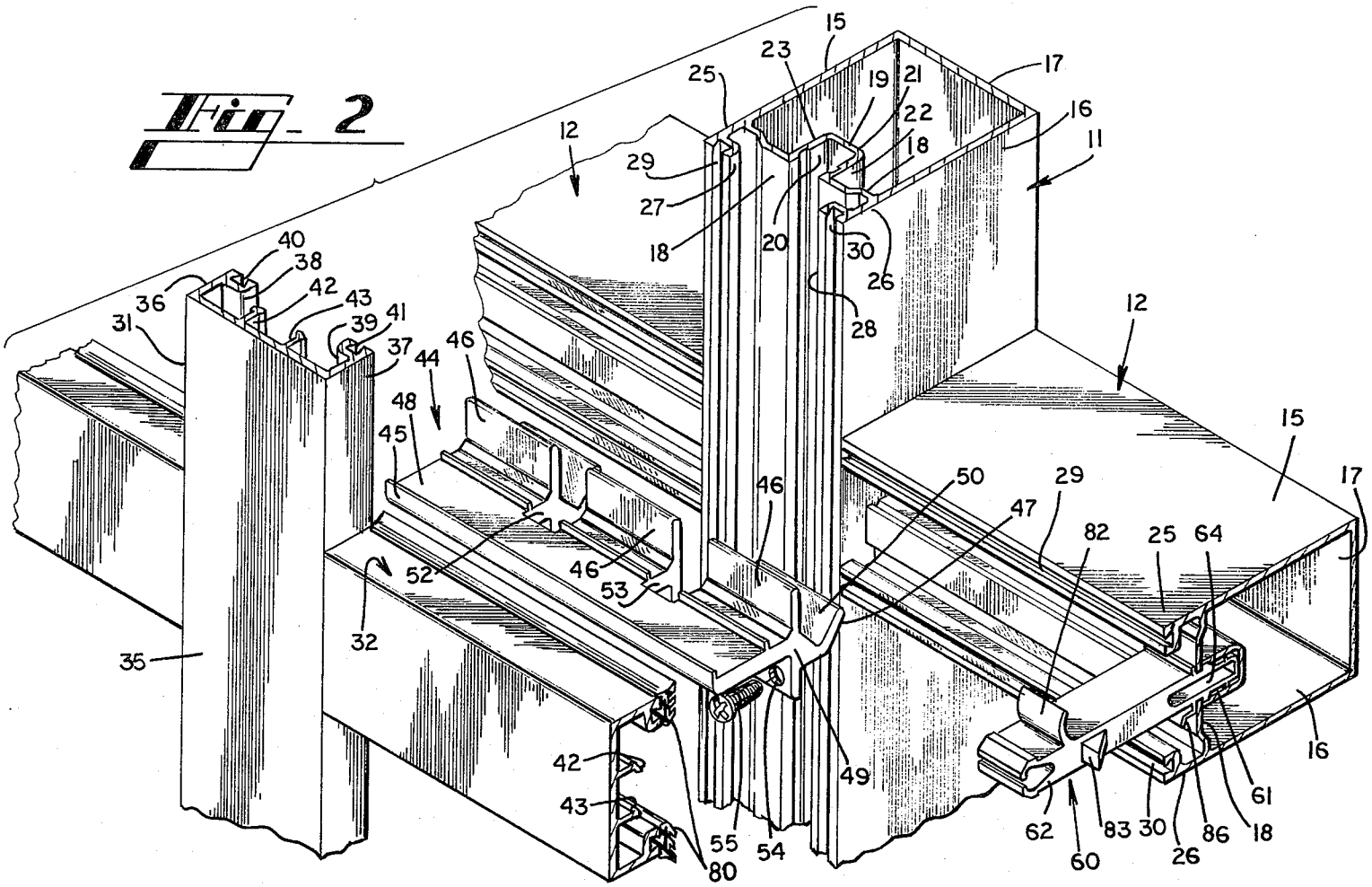
FIG. 2 is an exploded perspective illustration of a joint formed between a mullion and the horizontal supports extending on opposite sides of the mullion, a support clip, an attachment clip, and the cover plates.
Figure 4:
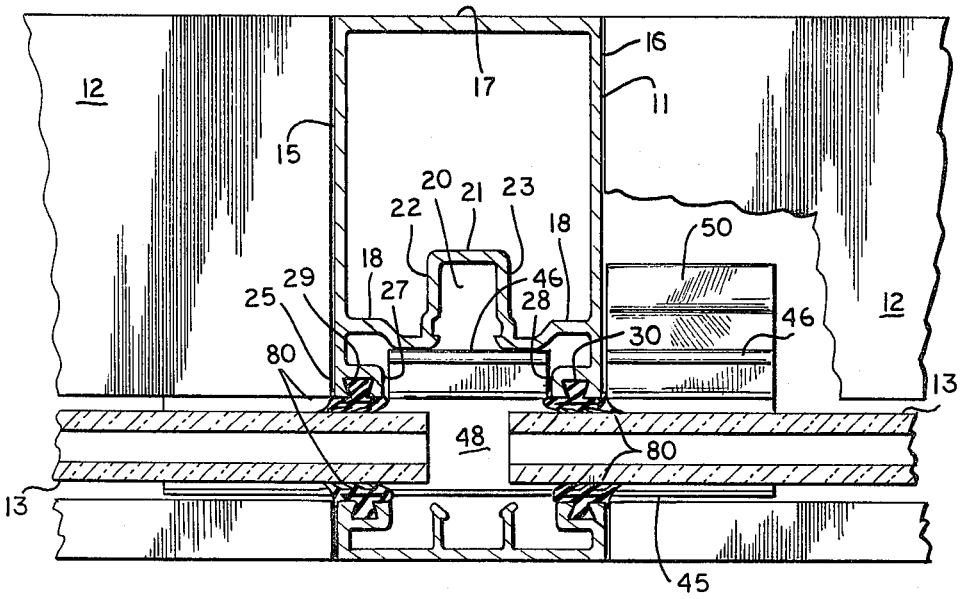
FIG. 4 is a plan view of a joint of the support framework, showing the mullion in cross-section and showing the end portions of the horizontal supports, with a portion of the right horizontal support broken away, and showing the slotted support clip, taken along lines 4—4 of FIG. 3, but also showing a portion of a pair of glass panels and a cover plate.

As best illustrated in FIGS. 2 and 8, cover plates 31 and 32 of identical cross-sectional shape are mounted opposite mullions 11 and horizontal supports 12. Cover plates 31 and 32 each comprise a front wall 35 (FIG. 8), opposed side walls 36 and 37, and L-shaped flanges 38 and 39 extending inwardly from the side walls, with the L-shaped flanges forming slots 40 and 41. Parallel flanges 42 protrude from the inner surface of front wall 35 and form a recess 43 that extends along the length of the coverplates. The recesses 43 of the coverplates 31 and 32 face and are aligned with the recesses 20 of the mullions and horizontal supports.

It should be noted that the horizontal supports and the mullions, which are identical in cross-section, and the cover plates are each symmetrically formed, in that the opposite halves of the horizontal supports and mullions are mirror images and the opposite halves of the cover plates are mirror images.

Figure 3:
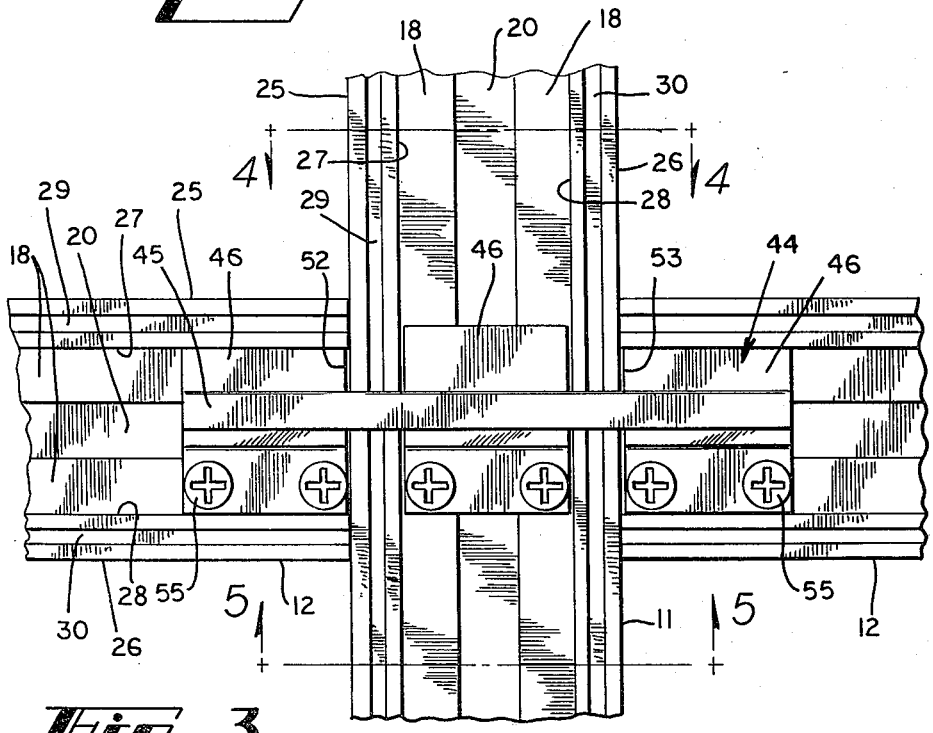
FIG. 3 is a front elevational view of a joint of the support framework, showing portions of a mullion and a pair of horizontal supports, and showing a slotted support clip with the cover plates and glass panels removed.
Figure 5:
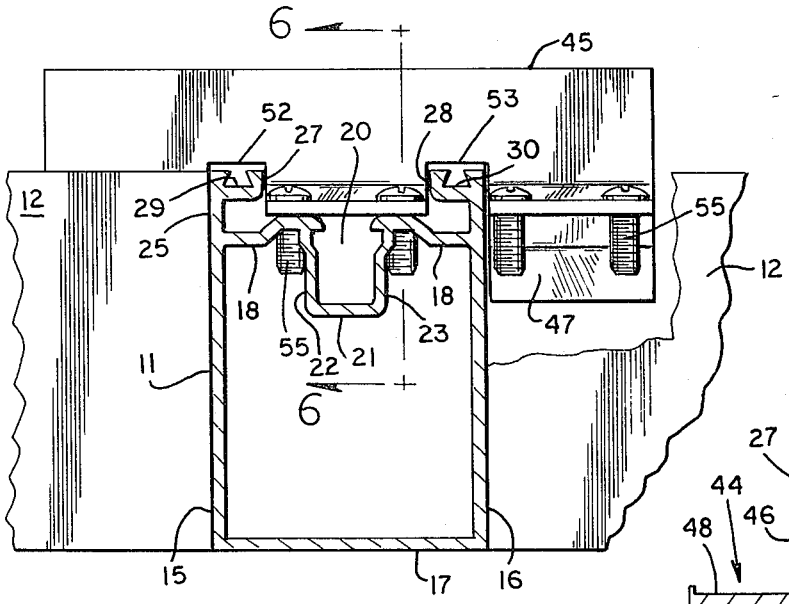
FIG. 5 is a bottom cross-sectional view of the joint of the framework of FIG. 3, taken along lines 5—5 of FIG. 3.
Figure 6:
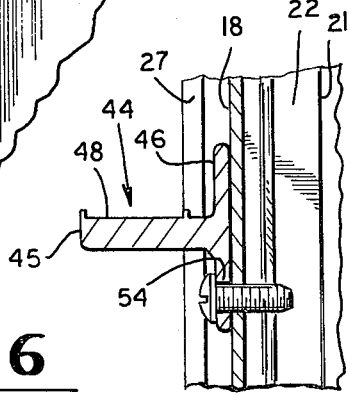
FIG. 6 is a detail side cross-sectional view of the mullion and slotted support clip of FIG. 5, taken along lines 6—6 of FIG. 5.
Figure 7:
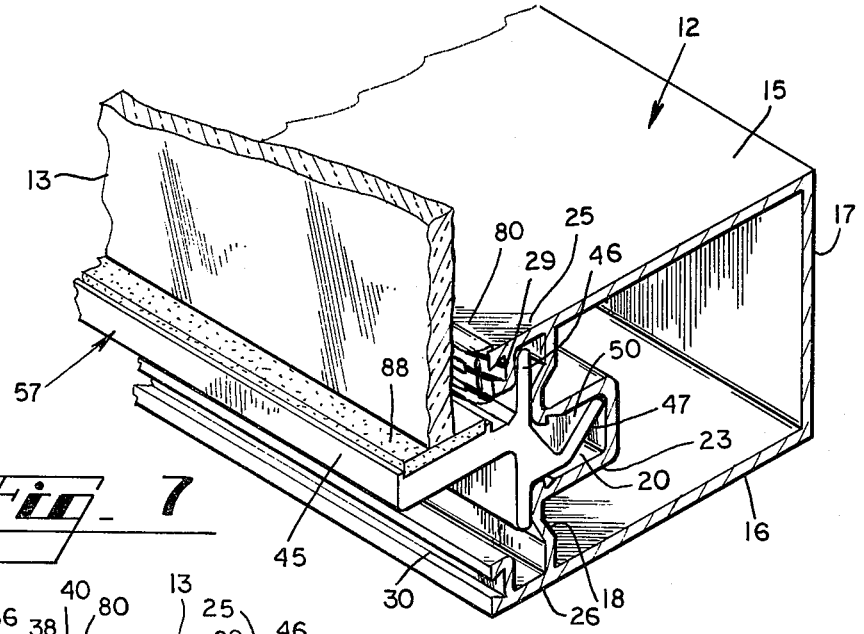
FIG. 7 is a detail perspective illustration of an unslotted support clip as inserted in a horizontal support, with a glass panel mounted on the support clip.

As best illustrated in FIG. 2, the support clip 44, which is slotted in FIGS. 2–6 and unslotted in FIGS. 7 and 8, comprises a setting block shelf 45, a mounting plate 46, and a support tongue 47. The setting block shelf 45 includes an upper surface 48 which will be oriented in a horizontal attitude when the support clip is attached to a horizontal support 12, as illustrated. Mounting plate 46 is oriented at a right angle with respect to the setting block shelf, with the setting block shelf protruding from the mounting plate at approximately the mid-height portion of the mounting plate. Support tongue 47 is approximately L-shaped and includes a base portion 49 extending from mounting plate 46 at a level lower than the setting block shelf, and a flange portion 50 extending at an approximately 45° angle upwardly from the base portion back to the level of the setting block shelf 45. Slots 52 and 53 are cut through the support tongue and mounting plate of the slotted support clip 44, the portion of the support tongue between the slots 52 and 53 is removed, and the slots 52 and 53 are of a width and depth sufficient to fit about the extensions 25 and 26 and their L-shaped flanges 27 and 28 of the mullion 11. The slots are of a depth sufficient to permit the mounting plate 46 between the slots 52 and 53 to abut the U-shaped front wall 18 of the mullion (FIGS. 5 and 6). Fastener openings 54 are formed in each segment of the slotted support clip 44, and threaded screws 55 or other fasteners extend through the fastener openings 54 and into the U-shaped front wall 18 of the mullions 11 and horizontal supports 12 to securely fasten the slotted support clip 44 to a mullion and to the horizontal supports on opposite sides of the mullion as illustrated in FIG. 3.

As illustrated in FIGS. 7 and 8, unslotted support clips 57 are similar to slotted support clips 44 in that they are of the same extruded shape but do not include the slots 52 and 53 and the support tongue is continuous from one end to the other of the support clips. As illustrated in FIG. 7, the unslotted support clips 57 include the setting block shelf 45, mounting plate 46 and support tongue 47. The unslotted support clips 57 are to be mounted in the horizontal supports 17 and are not intended to span about a mullion intermediate adjacent ones of the horizontal supports.

Figure 9:
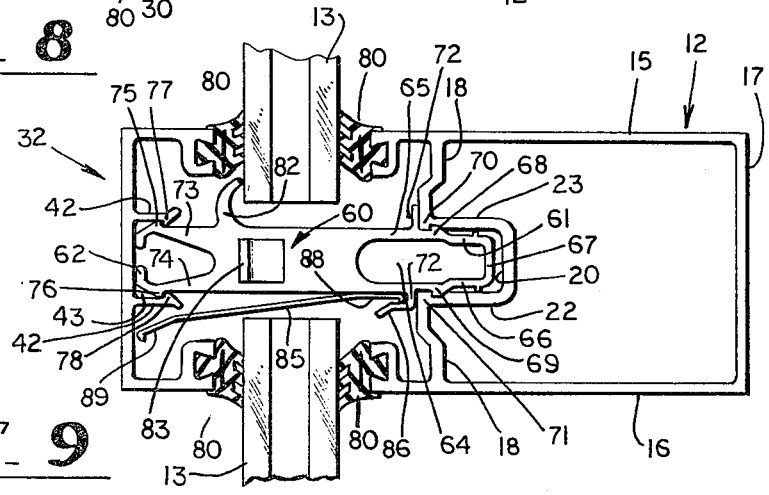
FIG. 9 is a side cross-sectional view of a horizontal support, the attachment clip, the upper and lower glass panels, and a cover plate.

As illustrated in FIGS. 2 and 9, attachment clips 60 are formed from molded plastic, such as Celcon, and each attachment clip 60 comprises an elongated shape of rectangular cross-section with an inner end portion 61 for insertion in the recess 20 of the front wall 18 of a mullion or horizontal support 11 or 12, and an outer end portion 62 for insertion between the flanges 42 and 43 of the cover plates 31 and 32. The attachment clips 60 each include an opening 64 at its inner portion that defines upper and lower wall segments 65 and 66, and end wall 67. The opening 64 permits the upper and lower wall segments 65 and 66 to flex toward each other when compressed. Outwardly protruding retaining ribs 68 and 69 are formed on the upper and lower wall segments 65 and 66, and corresponding inwardly protruding retaining ribs 70 and 71 are formed on the opposed side walls 22 and 23 of the U-shaped front wall 18 of the mullions and horizontal supports 11 and 12 (FIG. 9), so that the ribs 68 and 69 snap into the ribs 70 and 71 when the attachment clip 60 is forced into the recess 20 of the front wall 18. Upper and lower abutment protrusions 72 extend from upper and lower wall segments 65 and 66 and limit the movement of the attachment clip into the recess 20 of the front wall 18 of a mullion or horizontal support. This securely holds the attachment clip in place.

The outer end portion 62 of each attachment clip also includes upper and lower flexible wall segments 73 and 74 with outwardly protruding retaining ribs 75 and 76. The end portion 62 of the attachment clip 60 is sized and shaped to protrude into the recess 43 between flange 42 of the coverplates 31 and 32, so that the retaining ribs 75 and 76 move beyond the ribs 77 and 78 of the flanges 42 and 43, when the covers are inserted about the outer end portions of the attachment clips, causing the covers to snap onto the attachment clips. Soft seal strips 80 are threaded in slots 29, 30, 40 and 41 of the horizontal supports, mullions and cover plates and bear against the glass panels 13 to form a seal between the glass panels and the cover plates on one side, and the glass panels and the mullions and horizontal supports on the other side. Each attachment clip 60 includes a "Dutchman" or upwardly protruding retaining finger 82 adjacent its outer end portion 62. The Dutchman is located so that it will retain a glass panel 13 in abutment with a mullion or horizontal support 11 or 12 while a worker is assembling the storefront system.

A side protrusion 83 is formed on at least one side of each attachment clip 60. The side protrusion 83 permits the workman to insert a tool between a cover plate 31 or 32 and engage the side protrusion 83 and wedge the tool against the side protrusion and against the cover plate to dislodge the cover plate from the storefront assembly.

As illustrated in FIG. 9, a water drip shield 85 is located between the upper and lower glass panels 13, beneath the attachment clips 60. The drip shields 85 are formed of soft plastic material, are relatively flat, they extend the length of the storefront and are cut as necessary (not shown) to fit about the mullions, and they are of a width to extend from a horizontal support 12 to a cover plate 32, over the lower glass panel 13. A retaining ear 86 is formed on the bottom surface of each attachment clip 60 adjacent its inner end portion 61. The retaining ear 86 extends from lower abutment protrusion 72 approximately parallel to the lower wall segments 66 of the attachment clip 60. The drip shield 85 is arranged to be supported by the ear 86 in a sloped attitude, with the inner edge portion 88 located higher than the outer edge portion 89. With this arrangement, any liquid that is present within the space formed between the upper and lower glass panels 13 will tend to accumulate on the upper surface of drip shield 85, and the sloped arrangement of the drip shield will cause the water droplets to move by gravity to the trough 90 formed in the cover plate 32 where the water will accumulate outside the glass panels and run along the trough 90 to an end of the cover plate and fall to the outside.

When a worker assemblies the storefront system 10, the framework of mullions and horizontal supports can be assembled in place or can be assembled on a floor surface, etc. and later raised into place. The slotted support clips 44 are attached to the mullions 11 by inserting the slots 52 and 53 of the clips about the side extensions 25 and 26 and their L-shaped flanges 27 and 28 until the central mounting plate 46 abuts the U-shaped front wall 18 of the mullion 11. It will be understood that the support tongue 47 of the central segment of the support clip has been cut away from the structure, so that the mounting plate 46 makes flat contact with the U-shaped front wall 18 of the mullion. Holes are drilled through the U-shaped front wall 18 of the mullion, and screws 55 are threaded through the fastener openings 54 and the holes (not shown) in the mullions.

After the slotted support clips 44 have been mounted to the mullions, the worker installs the horizontal supports 12 by hanging the ends of the horizontal supports on the end segments of the slotted support clips 44. As illustrated in FIG. 8, the upper portion of the mounting plate 46 protrudes into the horizontal support 12 behind the L-shaped flange 27 and the support tongue 47 protrudes into the recess 20 of the U-shaped front wall 18. The base portion 49 of the support tongue 47 abuts the shelf formed by side wall 22 of the U-shaped front wall 18 while the edge of the flange portion 50 engages the shelf formed by side wall 23 of front wall 18. This forms a wedge connection between the slotted support clip and the horizontal support 12. Holes are drilled through the U-shaped front wall 18 of the horizontal support 12 and screws or similar fasteners 55 are inserted through the fastener openings 54 and the holes, to permanently connect the slotted support clips and horizontal supports 12.

After the horizontal supports 12 have been mounted to the mullions as described above, the worker inserts at least two unslotted support clips 57 (FIG. 7) in the recesses 20 of the horizontal supports 12, usually at the end one-quarter points along the length of the horizontal, and places pads 88 on the setting block shelf 45. The glass panels are placed with their lower edges on the pads 88 (FIG. 8). Next, the worker inserts attachment clips 60 in the recesses 20 of the horizontal supports 12 and in the recesses 20 of the mullions 11. The attachment clips 60 are located at positions between support clips 57 and the support clips can be located at various positions along the length of the horizontal which properly support the glass panels, as specified by the manufacturer of the glass panels. The Dutchman or retaining finger 82 of each fastener 60 tends to loosely hold the glass panel in place.

After the glass panels have been properly positioned, the worker applies the cover plates 31 and 32 to the exterior surface of the storefront system, by snapping the cover plates over the protruding end portions of the attachment clips 60. The seal strips 80 engage the internal and external surfaces of the glass panels 13, and the glass panels rest on the cushion 88. Therefore, the glass panels are compressed at their edges toward the support framework of mullins 11 and horizontal supports 12 and no hard contact is made against the glass panels. Moreover, the attachment clips 60 are made of a material that has a low coefficient of heat transfer, so that the heat from the mullions and horizontal supports 11 and 12 on one side of the structure is not readily transferred to the cover plates 31 and 32 on the other side of the structure, or visa versa.

While this invention has been described in detail with particular reference to a preferred embodiment thereof, it will be understood that variations and modifications can be effected within the spirit and scope of the invention as described hereinbefore and as defined in the appended claims.

I claim:

1. A window structure for a commercial building or the like wherein a plurality of rectangular glass panels are supported in a common plane by a plurality of spaced mullions and a plurality of horizontal supports connected between said mullions, the improvement therein of each of said horizontal supports including a recess extending along its length, at least one support clip including a support tongue and a setting block shelf including an upper surface extending approximately in a horizontal plane from said horizontal support, said support tongue including a base portion extending outwardly from said setting block shelf at a level lower than said setting block shelf, and a flange portion extending angularly upwardly from said base portion to the level of said setting block shelf and received in said recess, and said glass panels being supported at their lower edges in abutment with said mullions and horizontal supports by the setting block shelf of some of said support clips.

2. The window structure of claim 1 and wherein said support clip includes a mounting plate located between said setting block shelf and said support tongue and extending at an approximately right angle with respect to said setting block shelf, and at least one fastener connecting said mounting plate to said horizontal support.

3. The window structure of claim 2 and wherein said support tongue extends to a level lower than said setting block shelf.

4. The window structure of claim 2 and wherein the recess of each horizontal support includes a lower upwardly facing shelf and an upper downwardly facing shelf, and wherein said base portion of said support tongue of each said support clip is positioned adjacent said mounting plate for engagement with said lower upwardly facing shelf and said flange portion is positioned for engagement with said upper downwardly facing shelf of said horizontal support.

5. The window structure of claim 1 and wherein said mullions and said horizontal supports are of substantially the same cross-sectional shape, and wherein said support clips extend in wedged relationship in the recesses of adjacent ones of the horizontal supports about a mullion and are fastened to a mullion and mount the horizontal supports to the mullions.

6. The window structure of claim 1 and further including elongated attachment clips each including one end portion protruding into the recess of the horizontal supports and protruding from the horizontal supports beyond the plane of the glass panels, and an elongated cover plate extending parallel to each of said horizontal supports and mounted on the other end portion of said attachment clip and abutting the glass panels of the window structure.

7. A window structure for a commercial building or the like wherein a plurality of glass panels are supported in a common plane and in abutment with one side of a plurality of spaced mullions and a plurality of horizontal supports connected between the mullions, the improvement therein of each of said mullions and horizontal supports including a recess extending along its length and facing the plane of the glass panels, a plurality of elongated attachment clips each including an end portion extended into the recess of a mullion or a horizontal support and protruding from its mullion or horizontal support between the glass panels and beyond the plane of the glass panels, an elongated cover plate extending parallel to and opposite to each of said mullions and said horizontal supports and mounted to the other end portion of said attachment clips in abutting relationship with the glass panels of the window structure and at least one support clip including a tongue and a setting block shelf having an upper surface extending approximately in a horizontal plane from said horizontal support between and beyond the glass panels, said tongue extending outwardly from said setting block shelf approximately in a horizontal plane in wedge relationship with said recess in said horizontal support, a plate located between said setting block shelf and said tongue and extending at an approximate right angle with respect to said setting block shelf, and at least one fastener connecting said plate to said horizontal support.

8. The window structure of claim 7 and wherein each of said attachment clips includes a finger protrusion extending from adjacent its other end portion for engaging and holding the adjacent glass panel in abutment with the mullions and horizontal supports at a time before a cover plate is mounted to the other end portion of said attachment clip.

9. The window structure of claim 7 and further including a drain shelf positioned between adjacent horizontal edges of the glass panels, said drain shelf being of a width greater than the thickness of the glass panels and extending from within the recess of a horizontal support over the upper edge of a glass panel to the opposed cover plate, said attachment clips each including support means for supporting the edge of a drain shelf within the recess of a horizontal support at a higher level than the other edge thereof, whereby any liquid moving downwardly onto the drain shelf tends to move down the slope of the drain shelf away from the horizontal support and over the upper edge portion of the glass panel extending downwardly from the horizontal support.

10. The window structure of claim 7 and wherein said mullions and said horizontal supports are of extruded aluminum, and wherein said attachment clips are molded plastic material.

11. The window structure of claim 7 and wherein said mullions and said horizontal supports are of extruded aluminum, and wherein said attachment clips are of a material having a lower coefficient of heat transfer than aluminum.

12. The window structure of claim 7 and wherein said cover plates each include an elongated recess extending along its length and facing the plane of the glass panels and mounted about the attachment clips.

13. In a window structure for a commercial building or the like wherein a plurality of glass panels are supported by a support framework of upwardly extending mullions and laterally extending horizontal supports, with the glass panels supported at their edges by the mullions and horizontal supports, and cover plates engaging the edge portions of adjacent glass panels and spanning the spaces between adjacent glass panels, the improvement therein of means for connecting the cover plates to the mullions wherein said cover plates, mullions and horizontal supports each include recesses extending along their lengths and with the recesses of the cover plates and horizontal supports extending parallel to and facing each other, and with the recesses of other ones of the cover plates and the mullions extending parallel to and facing each other, and attachment clips each including one end portion for insertion into the recess of a horizontal support or the recess of a mullion and an opposite end portion for insertion into the recess of a cover plate, whereby cover plates are mounted to the window structure said attachment clips including a retaining ear, a setting block shelf having an upper surface extending from said attachment clip adjacent said horizontal support and defining a drip shield receiving channel between said retaining ear and said attachment clip and a drip shield comprising a plate having slopped portions adjacent opposite edges thereof, one of said sloped portions being selectively receivable in said channel and the other portion not contacting the horizontal support or cover plates.

14. The combination of claim 13 and wherein said attachment clips each include a retaining finger for holding a glass panel against the framework.

15. A window structure for a commercial building or the like wherein a plurality of rectangular glass panels are supported in a common plane by a plurality of spaced mullions and a plurality of horizontal supports connected between said mullions, the improvement therein of each of said horizontal supports including a recess extending along its length;

at least one support clip including a support tongue, a setting block shelf including an upper surface extending approximately in a horizontal plane from said horizontal support, a mounting plate located between said setting block shelf and said support tongue and extending at an approximately right angle with respect to said setting block shelf, and at least one fastener connecting said mounting plate to said horizontal support, said support tongue extending outwardly from said setting block shelf approximately in a horizontal plane in wedge relationship with said recess; and said glass panels being supported at their lower edges in abutment with said mullions and horizontal supports by the setting block shelf of some of said support clips.

16. The window structure of claim 15 and wherein said support tongue extends to a level lower than said setting block shelf.

17. The window structure of claim 15 and wherein the recess of each horizontal support includes a lower upwardly facing shelf and an upper downwardly facing shelf, and wherein the support tongue of each said support clip includes a base portion positioned adjacent said mounting plate for engagement with the lower upwardly facing shelf and a flange portion extending upwardly from said base portion and away from said mounting plate for engagement with the upper downwardly facing shelf of said horizontal support.

* * * * *